US008967625B2

(12) United States Patent
Wang

(10) Patent No.: US 8,967,625 B2
(45) Date of Patent: Mar. 3, 2015

(54) GAME MACHINE

(75) Inventor: Chih-Chieh Wang, Taichung (TW)

(73) Assignee: Youal-Jifh Enterprise Co., Ltd., Taichung (TW)

( * ) Notice: Subject to any disclaimer, the term of this patent is extended or adjusted under 35 U.S.C. 154(b) by 362 days.

(21) Appl. No.: 13/613,893

(22) Filed: Sep. 13, 2012

(65) Prior Publication Data

US 2014/0070490 A1 Mar. 13, 2014

(51) Int. Cl.
*A63F 9/00* (2006.01)

(52) U.S. Cl.
USPC ..... 273/440; 273/317

(58) Field of Classification Search
USPC ..... 273/317, 440, 445, 446, 454, 459, 460
See application file for complete search history.

(56) References Cited

U.S. PATENT DOCUMENTS

| | | | | |
|---|---|---|---|---|
| 6,315,157 | B1 * | 11/2001 | Halliburton | 221/87 |
| 7,600,760 | B2 * | 10/2009 | Matsuda et al. | 273/447 |
| 8,167,311 | B1 * | 5/2012 | Wang | 273/451 |
| 8,302,966 | B1 * | 11/2012 | Sullivan | 273/138.1 |
| 8,448,948 | B1 * | 5/2013 | Shoemaker, Jr. | 273/447 |
| 8,585,057 | B2 * | 11/2013 | Wang | 273/459 |

* cited by examiner

*Primary Examiner* — Nini Legesse

(57) ABSTRACT

A game machine includes a chest, a frame vertically disposed in an upper portion of the chest for containing prizes, a shoot unit disposed in the chest and corresponding to the frame, a ball recover unit disposed in a lower portion of the chest and a control unit disposed on the chest for controlling the shoot unit and the ball recover unit. The player can shoot a ball to strike a wanted prize by using the shoot unit. The player can take the prize after being stricken and falling from the frame. After shooting the ball, the control unit drives the ball recover unit to recover the shot ball and feed into the shoot unit for next operation.

20 Claims, 11 Drawing Sheets

GAME MACHINE

BACKGROUND OF THE INVENTION

1. Field of the Invention

The present invention relates to game machine, and more particularly to a game machine that shoots a ball and uses the flying ball to striking the prize, and the player can take the fallen prize.

2. Description of Related Art

The most popular game machine is a claw machine that uses a overhead travelling crane and a catcher to catch a wanted prize that is disposed in the game machine, wherein the overhead travelling crane is used as an X-Y axis moving unit and the catcher is used as a Z axis moving unit. The catcher is opened to release the caught prize when aligning with the dispensing hole and the player can get the prize as a reward.

However, the above conventional game machine includes several latent disadvantages. The conventional game machine uses an electromagnetic valve as a brake source such that the catcher immediately releases the caught prize when a power failure is caused and the player operates in vain. Consequently, some unworthy game machine manager suddenly go and return over human visual frequency to get a lawless huge benefit. Secondly, the power of the electromagnetic valve is adjusted or the original electromagnetic valve is change to one having a lower power. As a result, the catcher can not provide an enough clamping power to catch the purposed prize. It is unfair to the players.

The present invention has arisen to mitigate and/or obviate the disadvantages of the conventional game machine.

SUMMARY OF THE INVENTION

The main objective of the present invention is to provide an improved a game machine that shoots a ball and uses the flying ball to striking the prize, and the player can take the fallen prize.

To achieve the objective, the game machine in accordance with the present invention comprises an upstanding and rectangular chest. The chest includes a transparent upper portion, a partition horizontally mounted on a middle portion thereof and a panel formed on a front side of the chest. A slot device is mounted onto the panel, an opening is defined in a lower portion of the panel and a passage is disposed in the lower portion of the chest, wherein the passage extends toward the opening. A frame is vertically secured on a rear portion of the partition and has multiple rooms defined therein, wherein each room is hollowed from front to rear and receives a prize. A shoot unit is disposed in the chest and corresponds to the frame. The shoot unit includes a guide device mounted on the partition and a shoot device transversally mounted on a front portion of the partition, wherein the guide device and the shoot device can adjust a flying route of a ball that is hot by the shoot device. A ball recover unit is disposed in a lower portion of the chest for recovering the shot ball and transporting the recovered ball to the shoot device for next operation. A control unit is disposed on the panel of the chest, wherein the shoot unit and the ball recover unit are respectively electrically connected to the control unit.

According to the game machine in accordance with the present invention, all the requirements for getting the wanted prize are controlled under player's operation skill. Consequently, the unworthy game machine managers can not get improper income by adjusting the electromagnetic valve.

Accordingly, the players (consumers) can play the game machine under a fair condition.

Further benefits and advantages of the present invention will become apparent after a careful reading of the detailed description with appropriate reference to the accompanying drawings.

DETAILED DESCRIPTION OF THE INVENTION

Figure 1:
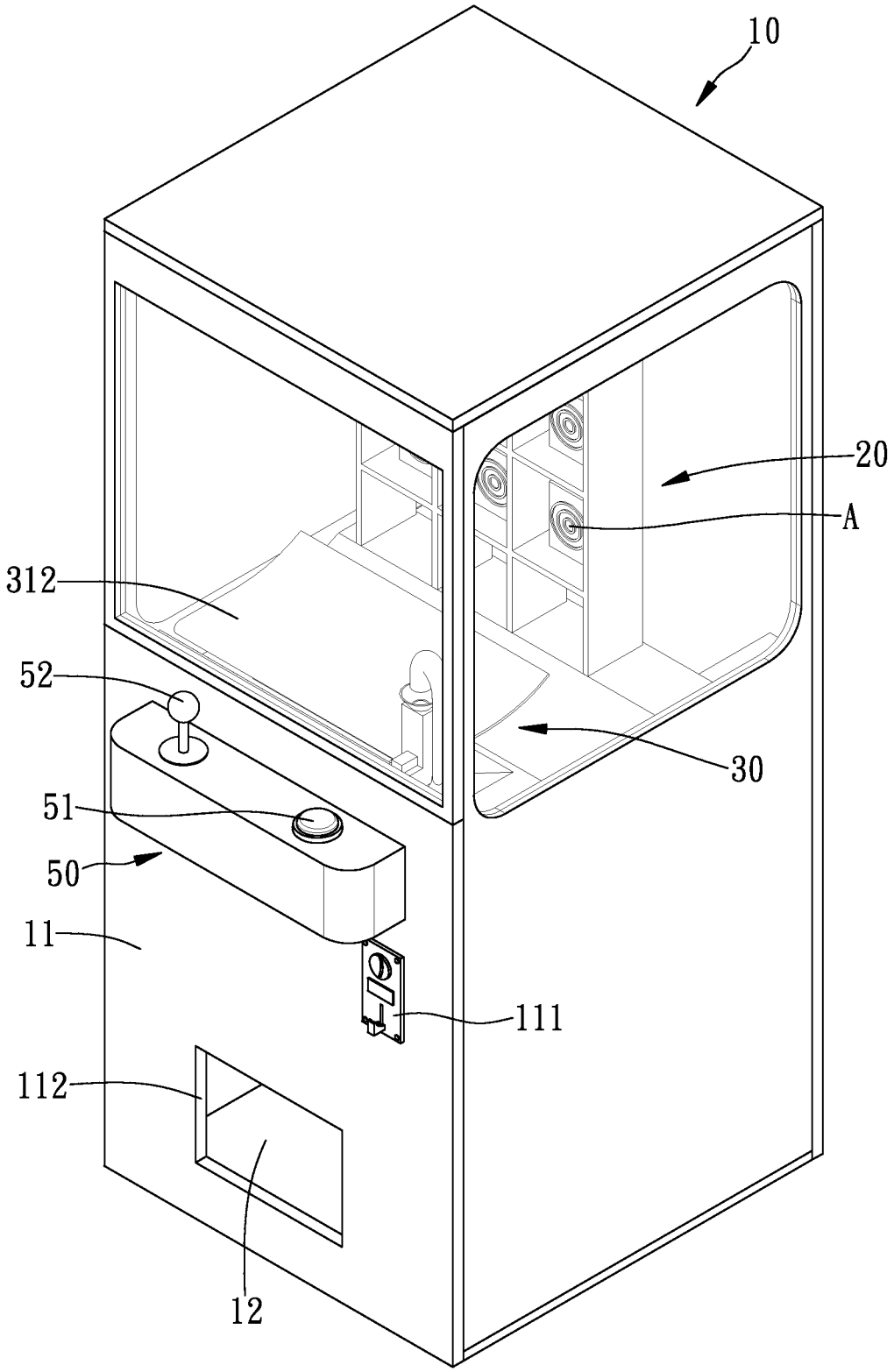
FIG. 1 is a perspective view of a game machine in accordance with the present invention.
Figure 2:
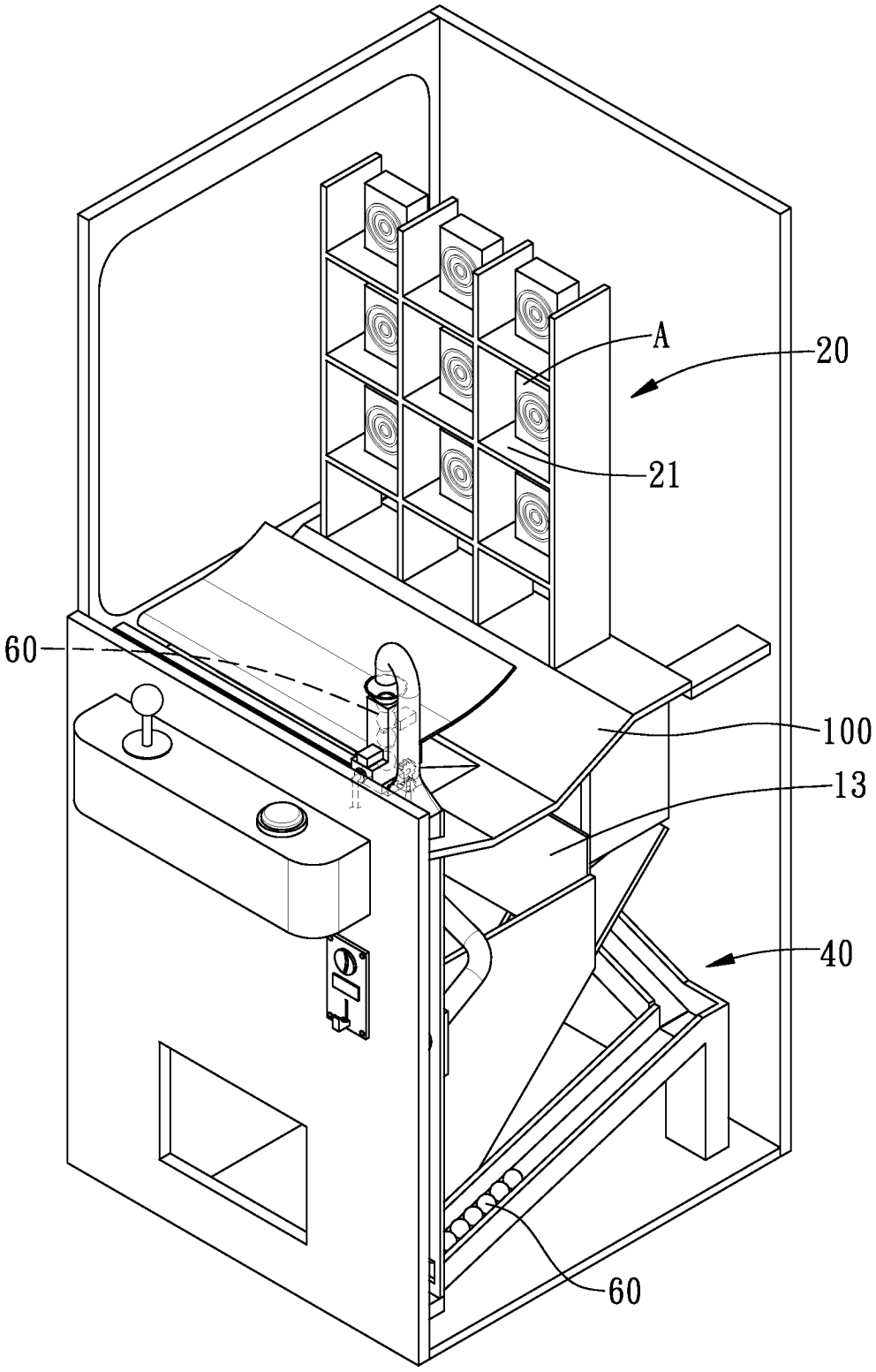
FIG. 2 is a partially perspective view of the game machine in FIG. 1.

Referring to the drawings and initially to FIGS. 1 and 2, a game machine in accordance with the present invention comprises chest (10), a frame (20) vertically disposed in an upper portion of the chest (10) for containing prizes (A), a shoot unit (30) disposed in the chest (10) and corresponding to the frame (20), a ball recover unit (40) disposed in a lower portion of the chest (10) and a control unit (50) disposed on the chest (10) for controlling the shoot unit (30) and the ball recover unit (40). The player can shoot a ball (60) to strike a wanted prize (A) by using the shoot unit (30). The player can take the prize (A) after being stricken and falling from the frame (20). After shooting the ball (60), the control unit (50) drives the ball recover unit (40) to recover the shot ball (60) and feed into the shoot unit (30) for next operation.

The chest (10) is an upstanding and rectangular structure, and has a transparent upper portion. Consequently, the player can visually select a prize (A) in the frame (20) and aim the wanted prize (A) by the shoot unit (30) for the purpose of shooting down the wanted prize (A). A partition (100) is horizontally mounted on a middle portion of the chest (10) and a panel (11) is formed on a front side of the chest (10). A slot device (111) is mounted onto the panel (11) and an opening (112) is defined in a lower portion of the panel (11), wherein the slot device (111) is electrically connected to the control unit (50). A passage (12) is disposed in the lower portion of the chest (10), the passage (12) can transport the falling prize (A) to the opening (112). An anti-theft gate (13) is pivotally mounted in the chest (10) to unidirectionally intercept the passage (12). The anti-theft gate (13) is pushed and only outwardly opened by the falling prize (A).

The frame (20) is vertically secured on a rear portion of the partition (100) and has multiple rooms (21) defined therein, wherein each room (21) is hollowed from front to rear and receives a prize (A).

Figure 4:
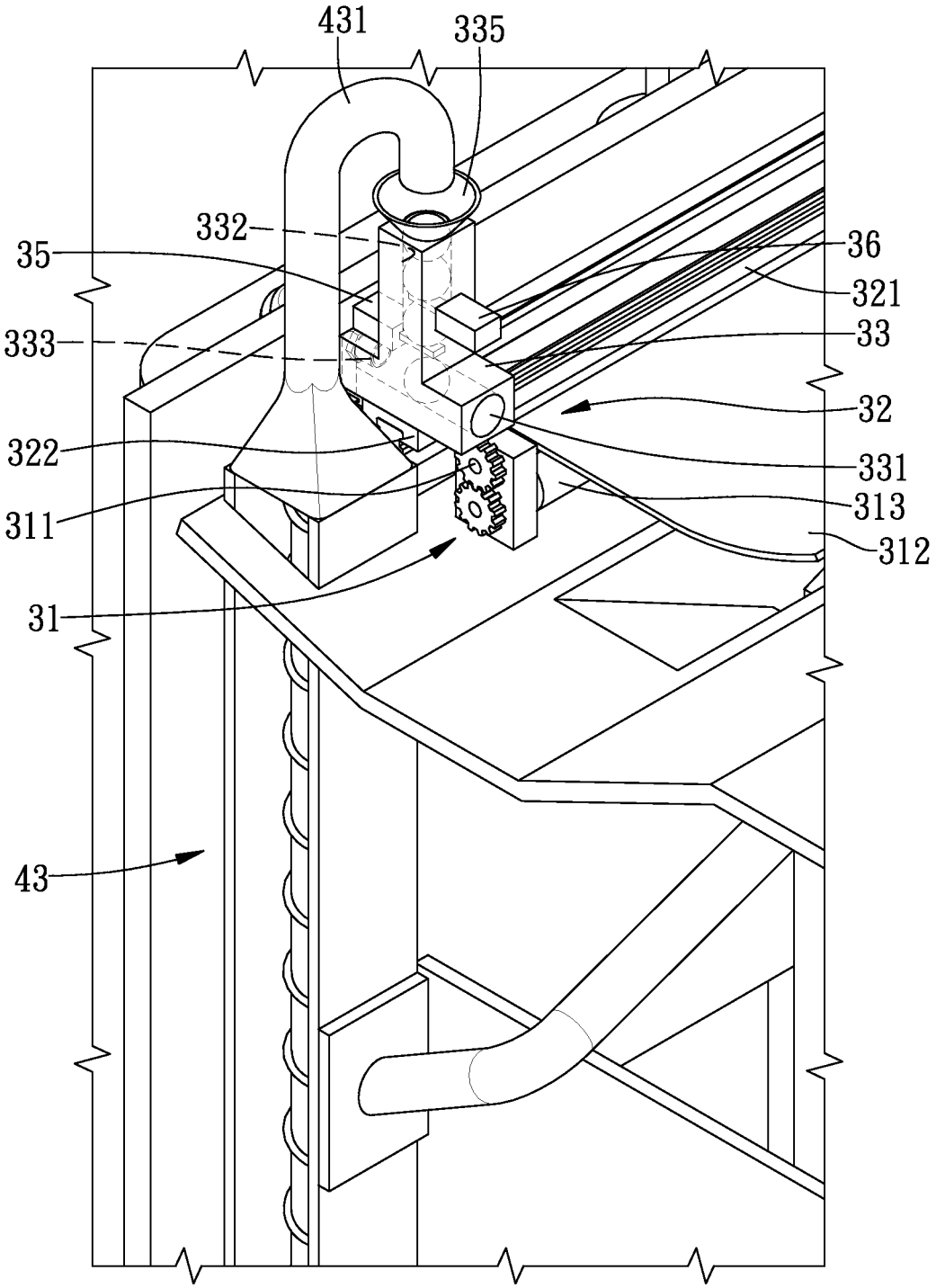
FIG. 4 is a partially perspective view of the game machine in accordance with the present invention.
Figure 5:
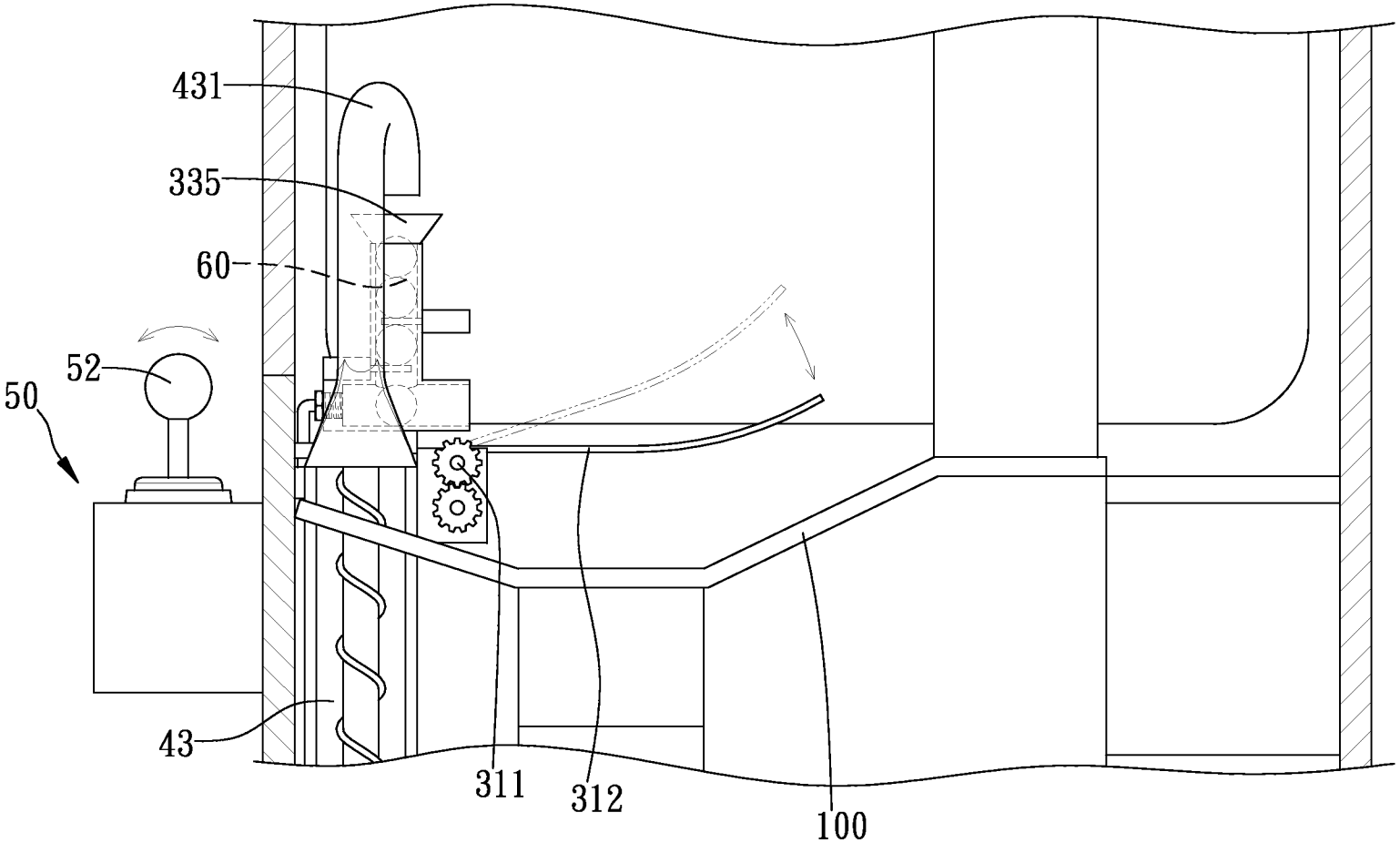
FIG. 5 is an operational view of a guide plate of the game machine of the present invention.
Figure 6B:
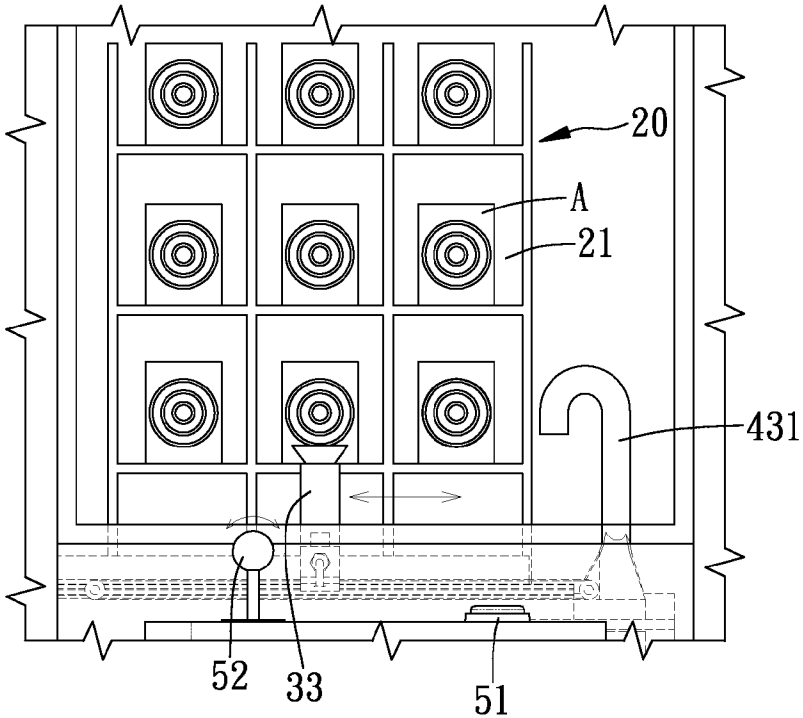
FIGS. 6A and 6B are operational views of a seat of the game machine of the present invention.
Figure 6A:
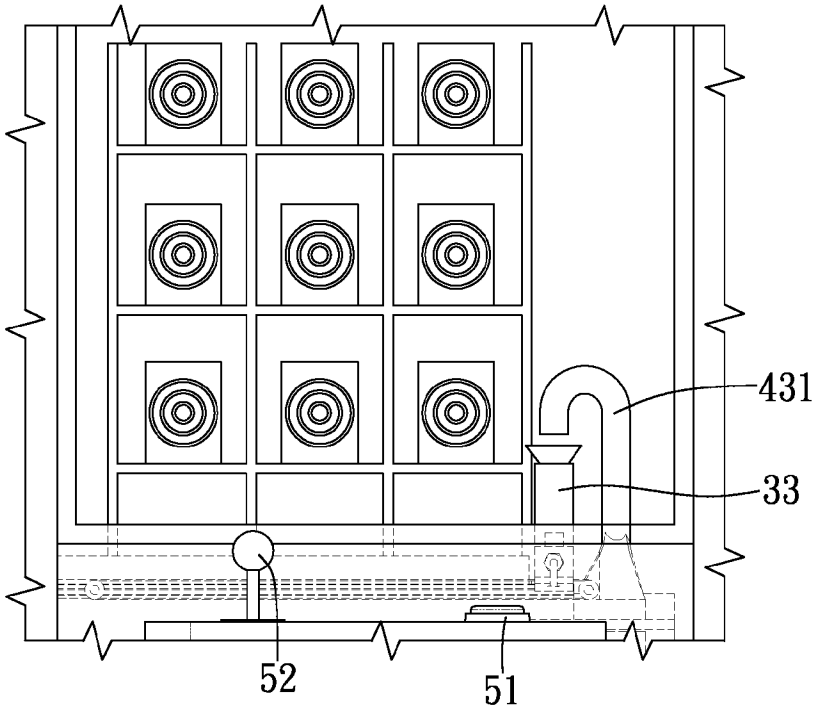
Figure 7:
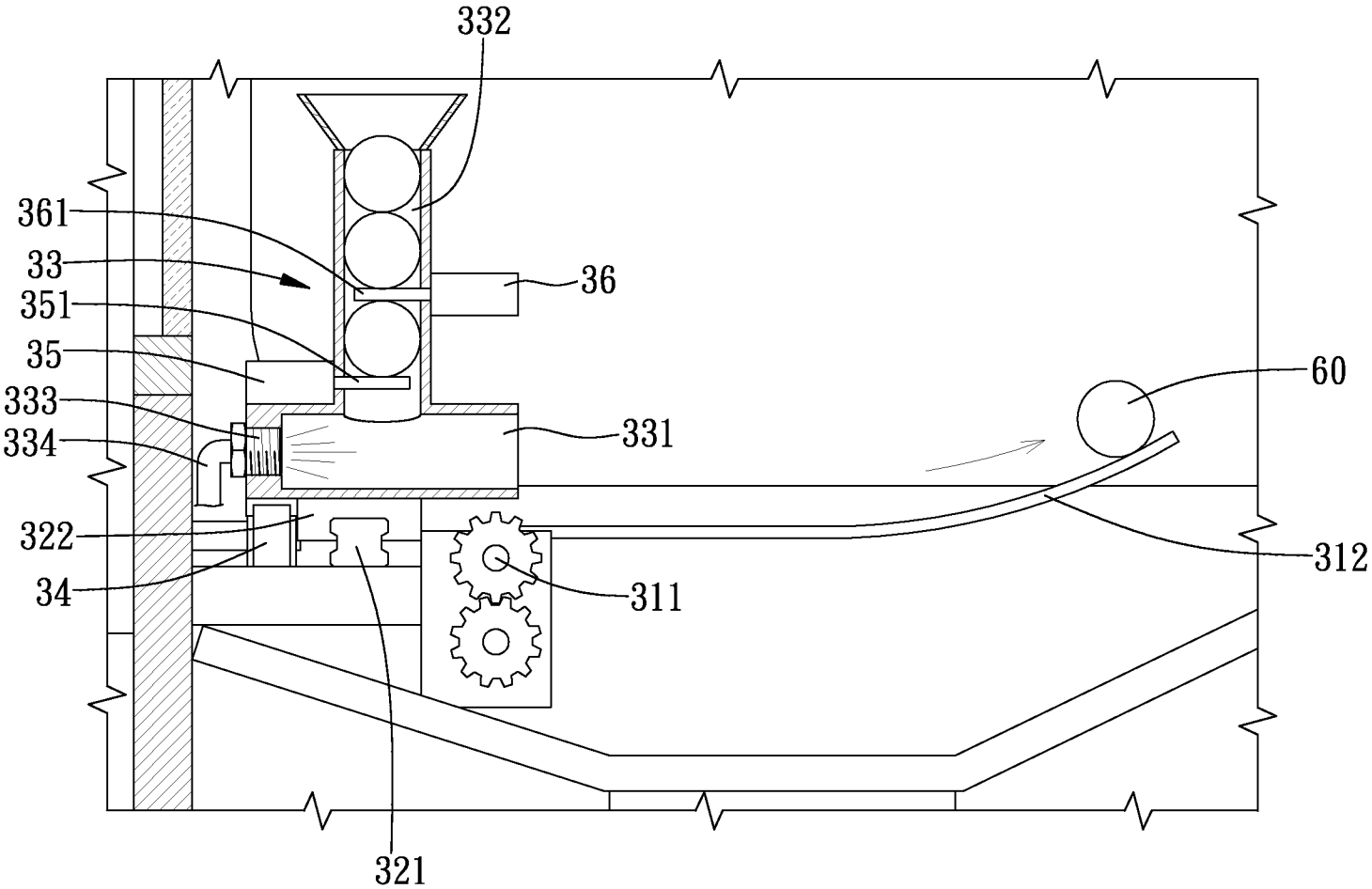
FIG. 7 is an operational view of a shoot device of the game machine of the present invention.

With reference to FIGS. 1, 4 and 7, the shoot unit (30) includes a guide device (31) mounted on the partition (100) and a shoot device (32) transversally mounted on a front portion of the partition (100). The guide device (31) includes an axle (311) transversally and rotatably mounted on the partition (100) and a guide plate (312) radially secured on the axle (311), wherein the free edge of the guide plate (312) extends toward the frame (20). A motor (312) is secured on the partition (100). The motor (312) is connected to the axle (311) and electrically connected to the control unit (50) for driving the axle (311) and adjusting an elevation angle of the guide plate (312). The shoot device (32) includes a rail (321) transversally secured on the partition (100), a slider (322) slidably mounted on the rail (321), a seat (33) secured on the slider (322) and a drive device (34) connected to the seat (33). The drive device (34) is electrically connected to the control unit (50) for driving the seat (33) such that the seat (33) is reciprocally moved relative to the rail (321) due to the slider (322). The seat (33) includes a shoot passage (331) defined therein and extending therethrough, wherein the shoot passage (331) extends toward the frame (20). A ball passage (332) is defined in the seat (33) and communicates with the shoot passage (331), wherein the ball passage (332) upwardly extends to a top of the seat (33). A control valve (333) is disposed in one end of the shoot passage (331) opposite to the frame (20). The control valve (333) is connected to a high-pressure air source (not shown) via an air hose (334) and electrically connected to the control unit (50). A funnel (335) is secured on the top of the seat (33) for guiding the ball (60), which is provided by the ball recover unit (40) moved into the ball passage (332). A first electromagnetic valve (35) and a second electromagnetic valve (36) are respectively mounted onto the seat (33) and electrically connected to the control unit (50), wherein the first electromagnetic valve (35) has a position lower than that of the second electromagnetic valve (36). The first electromagnetic valve (35) and the second electromagnetic valve (36) respectively have a first shaft (351) and a second shaft (361) extending into the ball passage (332), wherein a distance between the two shafts (351, 361) is slightly greater than a diameter of the ball (60) for controlling the balls (60) falling into the shoot passage (331) one after one.

Figure 8C:
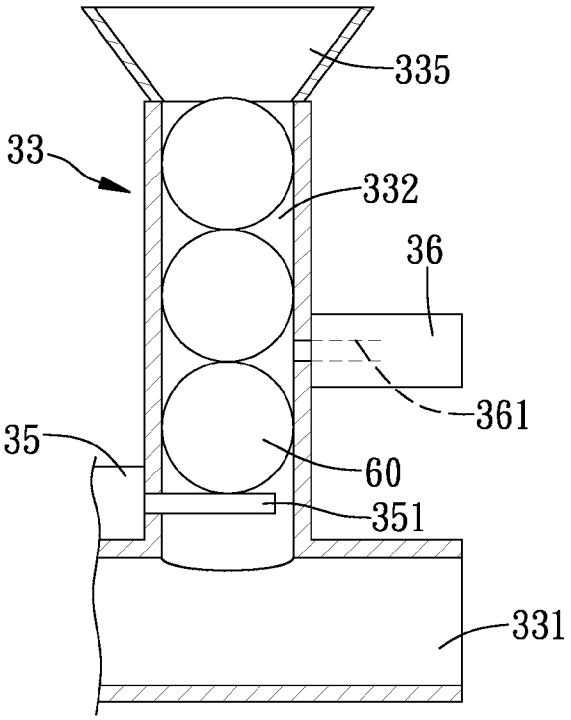
FIGS. 8A to 8C are operational views of the first electromagnetic valve and the second electromagnetic valve.
Figure 8B:
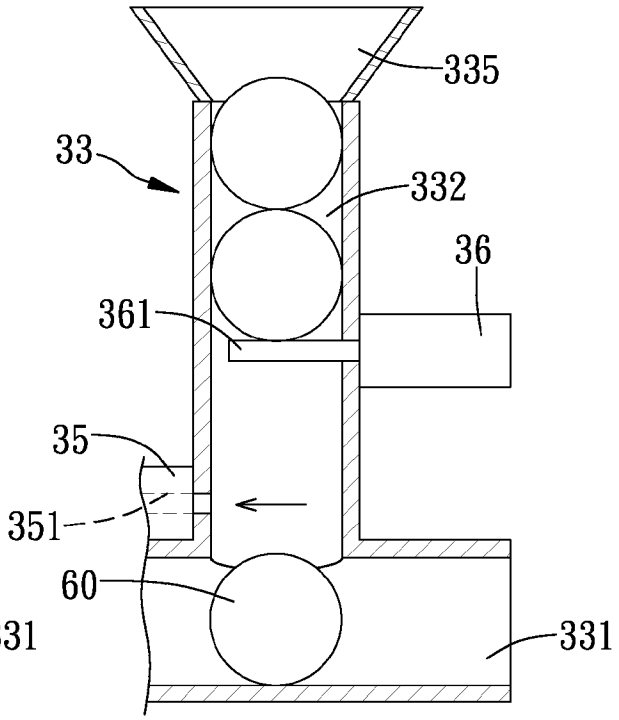
Figure 8A:
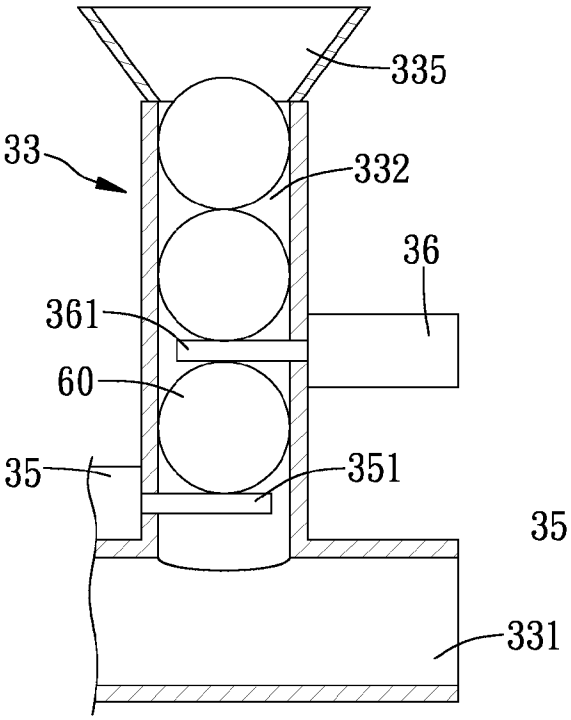

With reference to FIGS. 8A to 8C, when finishing shooting, the first shaft (351) and the second shaft (361) respectively extend into the ball passage (332) and there is no ball (60) between the two shafts (351, 361). When the game is started, the control unit (50) drives the second electromagnetic valve (36) to make second shaft (361) fully moved backward thereinto such the balls (60) are fallen and stopped by the first shaft (351). Next, the second shaft (361) extends into the ball passage (332) again such that the ball (60) is kept between the first shaft (351) and the second shaft (361). Finally, the control unit (50) drives the first electromagnetic valve (35) to make the first shaft (351) carrying a reciprocal movement out, such that the ball (60), between first shaft (351) and the second shaft (361) falls into the shoot passage (331).

Figure 3:
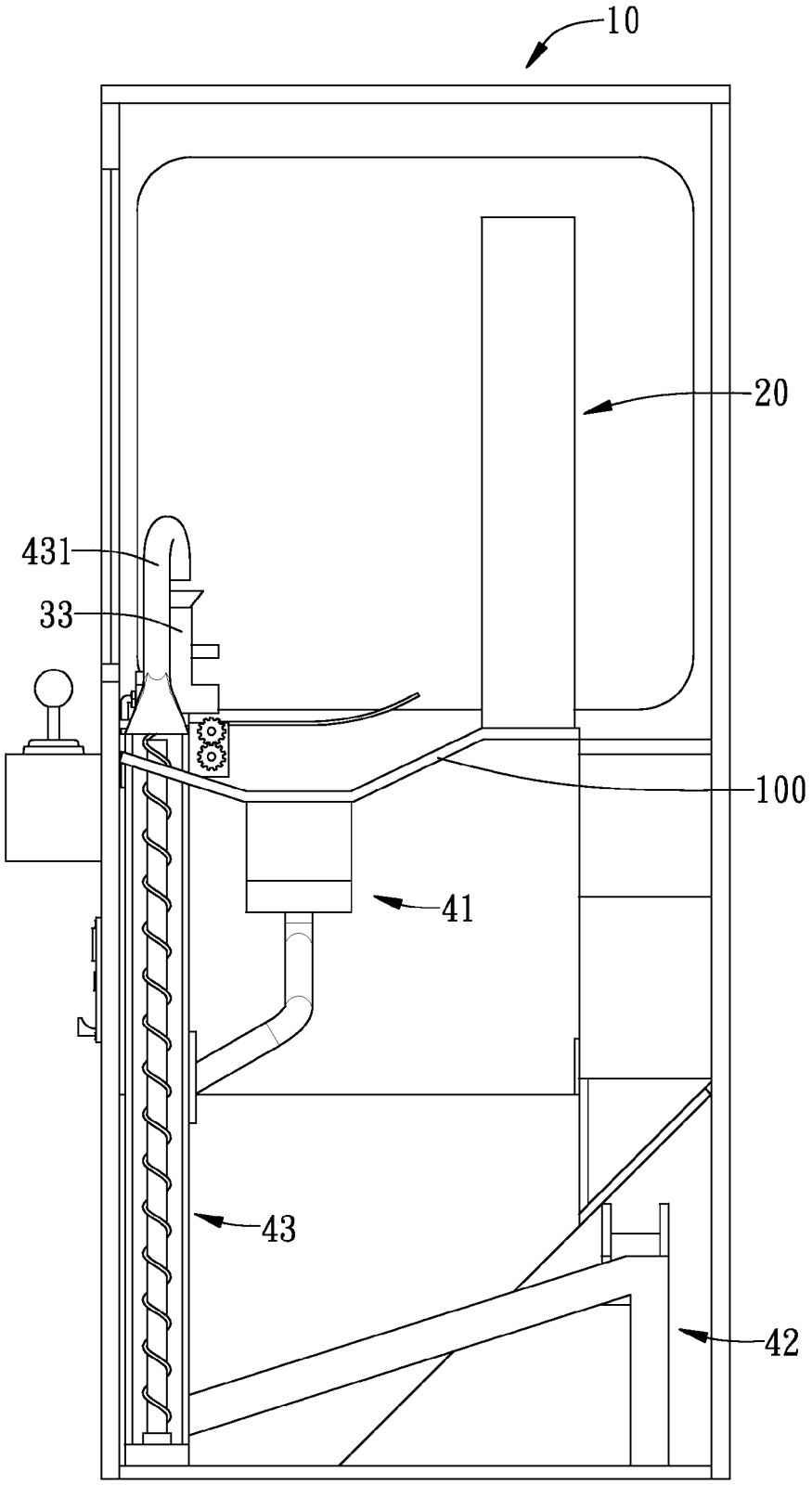
FIG. 3 is a right side plan view of the game machine in FIG. 2.

With reference to FIGS. 2 and 3, the ball recover unit (40) includes a front recover device (41), a rear recover device (42) and a feeding device (43) respectively received in the lower portion of the chest (10), wherein the feeding device (43) is electrically connected to the control unit (50). The front recover device (41) and the rear recover device (42) are respectively connected to the feeding device (43). The front recover device (41) recovers the balls (60) falling front of the frame (20) and the rear recover device (42) recovers the balls (60) falling behind the frame (20), wherein the recovered balls (60) rolling to the feeding device (43) and the feeding device (43) transports the balls (60) to the shoot device (32) before starting the game. The feeding device (43) has an inverted J-shaped feeding tube (341) mounted on a top thereof. The ball passage (332) aligns with the free end of the feeding tube (431) for receiving the balls (60) from the feeding device (43) through the feeding tube (431) when the seat (33) is moved to abut the feeding device (43).

With reference to FIG. 1, the control unit (50) includes a button (51) and a stick (52) mounted thereon. The player can leftward and rightward operate the stick (52) to drive the drive device (34) and adjust the position of the seat (33) of the shoot device (30) along the rail (321). In addition, the player can forward and backward operate the stick (52) to drive the motor (313) and adjust the elevation angle of the guide plate (312).

With reference to FIGS. 5, 7 to 8C, when operating the game machine in accordance with the present invention, the player must insert some tokens or coins into the slot device (111). The control unit (50) drives the feeding device (43), the first electromagnetic valve (35) and the second electromagnetic valve (36) to provide a ball (60) into the shoot passage (331) in the seat (32). Before shooting the ball (60), the player must adjust the elevation angle of the guide plate (312) and the position of the seat (33) according to the wanted prize (A). The control unit (50) operates the control valve (333) to make the high-pressure air suddenly flowing into the shoot passage (331) and shooting the ball (60) after the player pressing the button (51). The shot ball (60) flies toward the wanted prize (A) after passing through the guide plate (312). The flying ball (60) will strike the wanted prize (A) when the guide plate (312) is adjusted to a suitable elevation angle and the shoot device (32) is moved to a suitable position. The stricken prize (A) falls into the passage (12), pushes the anti-theft gate (13) and moves to the opening (112), and the player can take his/her wanted prize.

The shot ball (A) will strike the frame (20), spring back and be recovered to the feeding device (43) via the front recover device (41). The shot ball (60) is recovered by the rear recover device (42) when passing through the frame (20) or flying over the frame (20).

Figure 9:
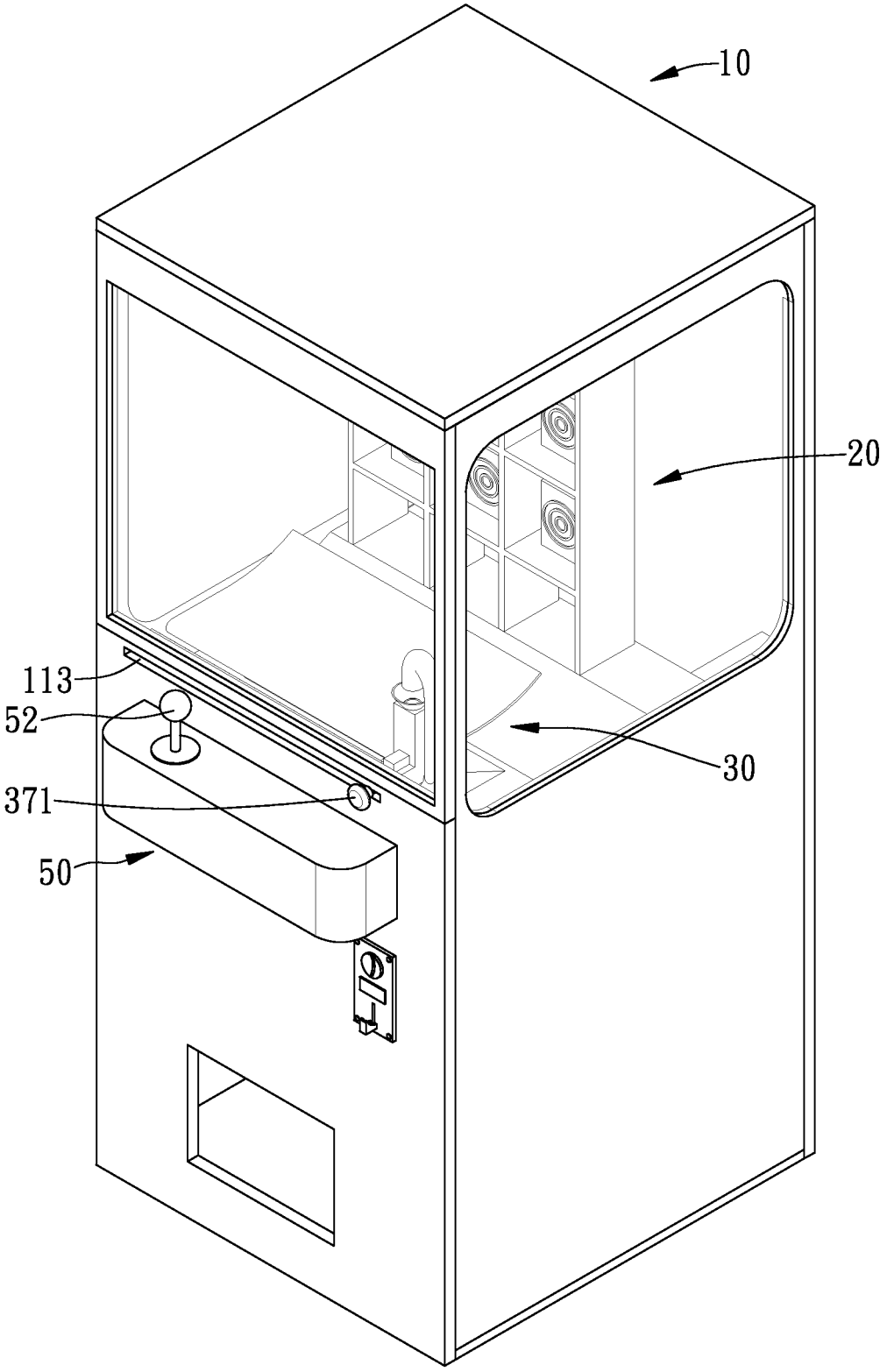
FIG. 9 is a perspective view of a second embodiment of the game machine in accordance with the present invention.
Figure 10:
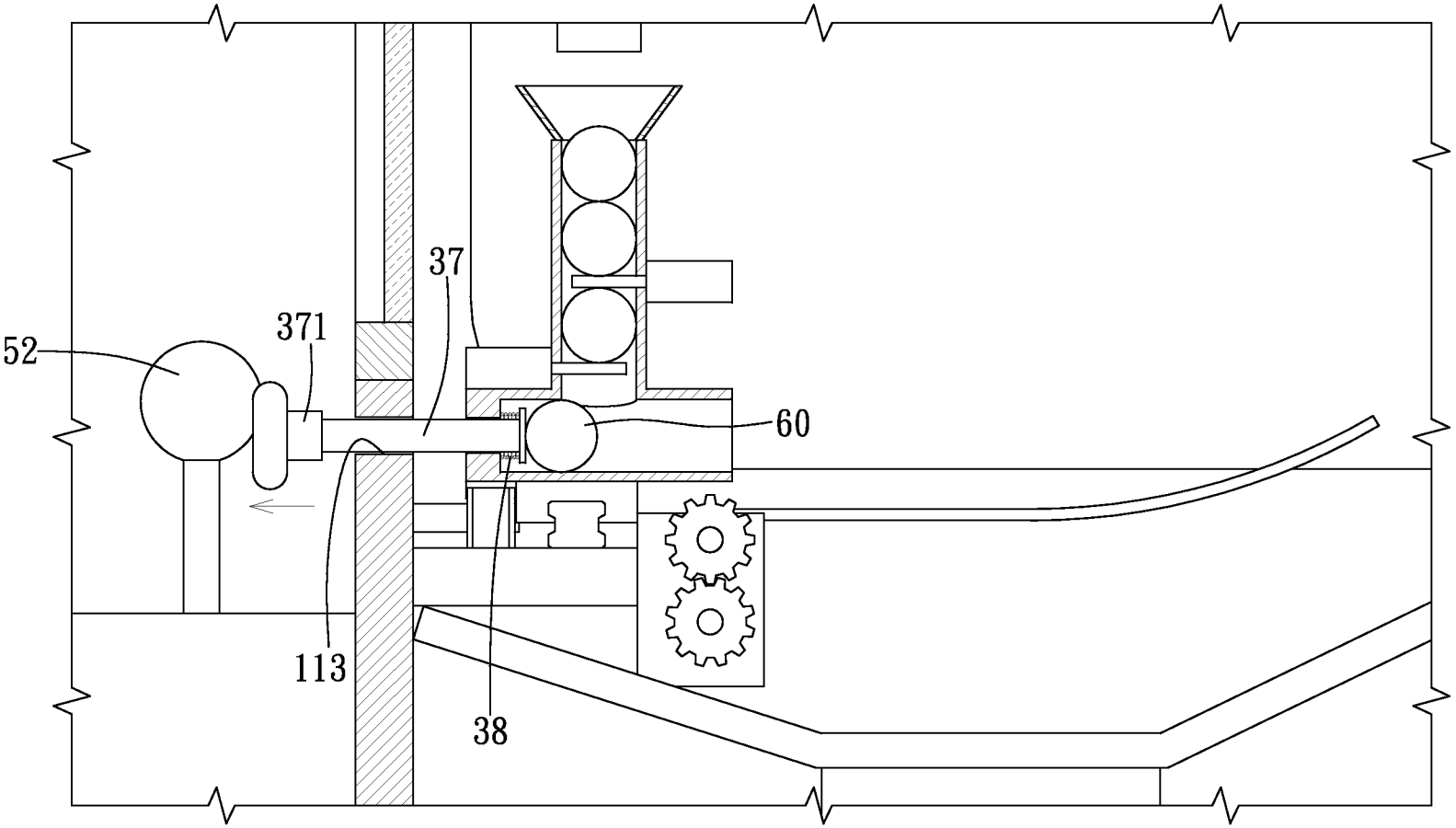
FIGS. 10 and 11 are operational views of the game machine in FIG. 9.
Figure 11:
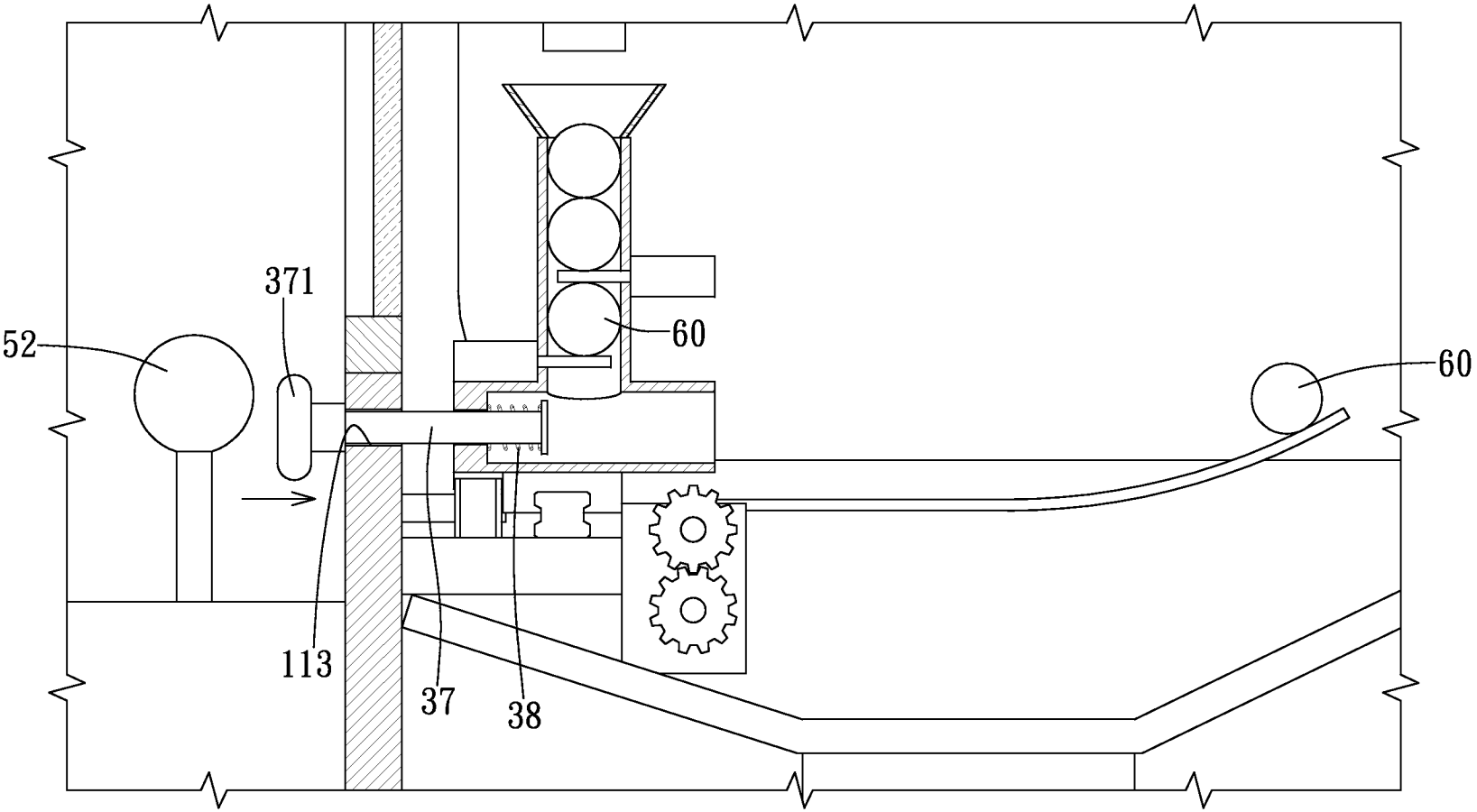

With reference to FIGS. 9 to 11 that show a second embodiment of the game machine in accordance with the present invention, in this embodiment, the game machine uses a restitution force of a spring to shot the ball (A). Most structures of the second embodiment of the present invention are the same as that of the first embodiment as described above. Only the different between the two embodiments is described, hereinafter.

The panel (11) of the chest (10) further includes a horizontal groove (113) defined therein and extending therethrough. A pull rod (37) is slidably received in the shoot passage (331). A spring (38) is compressively sleeved on the pull rod (37) and received in the shoot passage (331). One end of the pull rod (37) extends through the horizontal groove (113) and has a stopper (371) secured thereon. The previous operations before shooting the ball (60) of the second embodiment are the same as that of the first embodiment. Only the shoot power, restitution force of the spring (38), is different from the first embodiment. The spring (38) is compressed when the player backward pull the pull rod (37) and the restitution force of the spring (38) drives the pull rod (37) to strike and shoot the ball (60) in the shoot passage (331) such that the shot ball (60) flies toward the wanted prize (A). In the second embodiment of the present invention, the high-pressure air is unnecessary. Accordingly, the button (51) of the control unit (50) of the first embodiment is necessary to the second embodiment of the present invention.

As described above, all the requirements for getting the wanted prize are controlled under player's operation skill. Consequently, the unworthy managers can not get improper income by adjusting the electromagnetic valve. Accordingly, the players (consumers) can play the game machine under a fair condition.

Although the invention has been explained in relation to its preferred embodiment, it is to be understood that many other possible modifications and variations can be made without departing from the spirit and scope of the invention as hereinafter claimed.

What is claimed is:

1. A game machine comprising:

an upstanding and rectangular chest having a transparent upper portion, a partition horizontally mounted on a middle portion of the chest and a panel formed on a front side of the chest, a slot device mounted onto the panel and an opening defined in a lower portion of the panel, a passage disposed in the lower portion of the chest, the passage extending toward the opening;

a frame vertically secured on a rear portion of the partition and having multiple rooms defined therein, wherein each room is hollowed from front to rear and receives a prize;

a shoot unit disposed in the chest and corresponding to the frame, the shoot unit including a guide device mounted on the partition and a shoot device transversally mounted on a front portion of the partition, wherein the guide device and the shoot device can adjust a flying route of a ball that is hot by the shoot device;

a ball recover unit disposed in a lower portion of the chest for recovering the shot ball and transporting the recovered ball to the shoot device for next operation; and a control unit disposed on the panel of the chest, wherein the shoot unit and the ball recover unit are respectively electrically connected to the control unit.

2. The game machine as claimed in claim 1, wherein the ball recover unit includes a front recover device, a rear recover device and a feeding device respectively received in the lower portion of the chest, wherein the feeding device is electrically connected to the control unit, the front recover device and the rear recover device respectively connected to the feeding device, the front recover device recovering the balls falling front of the frame and the rear recover device recovering the balls falling behind the frame, wherein the recovered balls rolling to the feeding device and the feeding device transports the balls to the shoot device.

3. The game machine as claimed in claim 1, wherein the guide device includes an axle transversally and rotatably mounted on the partition and a guide plate radially secured on the axle, wherein the free edge of the guide plate extends toward the frame, a motor secured on the partition, the motor connected to the axle and electrically connected to the control unit for driving the axle and adjusting an elevation angle of the guide plate.

4. The game machine as claimed in claim 3, wherein the ball recover unit includes a front recover device, a rear recover device and a feeding device respectively received in the lower portion of the chest, wherein the feeding device is electrically connected to the control unit, the front recover device and the rear recover device respectively connected to the feeding device, the front recover device recovering the balls falling front of the frame and the rear recover device recovering the balls falling behind the frame, wherein the recovered balls rolling to the feeding device and the feeding device transports the balls to the shoot device.

5. The game machine as claimed in claim 3, wherein the shoot device includes a rail transversally secured on the partition, a slider slidably mounted on the rail, a seat secured on the slider and a drive device connected to the seat, the drive device electrically connected to the control unit for driving the seat such that the seat is reciprocally moved relative to the rail due to the slider, the seat including a shoot passage defined therein and extending therethrough, wherein the shoot passage extends toward the frame, a ball passage is defined in the seat and communicates with the shoot passage, wherein the ball passage upwardly extends to a top of the seat.

6. The game machine as claimed in claim 5, wherein the shoot device includes a first electromagnetic valve and a second electromagnetic valve respectively mounted onto the seat and electrically connected to the control unit, wherein the first electromagnetic valve has an elevation position lower than that of the second electromagnetic valve, the first electromagnetic valve and the second electromagnetic valve respectively having a first shaft and a second shaft extending into the ball passage, wherein a distance between the two shafts is slightly greater than a diameter of the ball for controlling the balls falling into the shoot passage one after one.

7. The game machine as claimed in claim 6, wherein the ball recover unit includes a front recover device, a rear recover device and a feeding device respectively received in the lower portion of the chest, wherein the feeding device is electrically connected to the control unit, the front recover device and the rear recover device respectively connected to the feeding device, the front recover device recovering the balls falling front of the frame and the rear recover device recovering the balls falling behind the frame, wherein the recovered balls rolling to the feeding device and the feeding device transports the balls to the shoot device.

8. The game machine as claimed in claim 7, the seat includes a control valve disposed in one end of the shoot passage opposite to the frame, the control valve connected to a high-pressure air source via an air hose and electrically connected to the control unit, and the control unit includes a button and a stick mounted thereon, wherein the player leftward and rightward operates the stick to drive the drive device and adjust the position of the seat of the shoot device along the rail, and forward and backward operates the stick to drive the motor and adjust the elevation angle of the guide plate.

9. The game machine as claimed in claim 8, wherein the feeding device has an inverted J-shaped feeding tube mounted on a top thereof and wherein the ball passage aligns with the free end of the feeding tube for receiving the balls from the feeding device through the feeding tube when the seat is moved to abut the feeding device.

10. The game machine as claimed in claim 9, wherein the seat includes a funnel secured on the top thereof for guiding the ball, which is provided by the ball recover unit, moved into the ball passage.

11. The game machine as claimed in claim 6, the seat includes a control valve disposed in one end of the shoot passage opposite to the frame, the control valve connected to a high-pressure air source via an air hose and electrically connected to the control unit, and the control unit includes a button and a stick mounted thereon, wherein the player leftward and rightward operates the stick to drive the drive device and adjust the position of the seat of the shoot device along the rail, and forward and backward operates the stick to drive the motor and adjust the elevation angle of the guide plate.

12. The game machine as claimed in claim 11, wherein the feeding device has an inverted J-shaped feeding tube mounted on a top thereof and wherein the ball passage aligns with the free end of the feeding tube for receiving the balls from the feeding device through the feeding tube when the seat is moved to abut the feeding device.

13. The game machine as claimed in claim 12, wherein the seat includes a funnel secured on the top thereof for guiding the ball, which is provided by the ball recover unit, moved into the ball passage.

14. The game machine as claimed in claim 5, wherein the ball recover unit includes a front recover device, a rear recover device and a feeding device respectively received in the lower portion of the chest, wherein the feeding device is electrically connected to the control unit, the front recover device and the rear recover device respectively connected to the feeding device, the front recover device recovering the balls falling front of the frame and the rear recover device recovering the balls falling behind the frame, wherein the recovered balls rolling to the feeding device and the feeding device transports the balls to the shoot device.

15. The game machine as claimed in claim 14, the seat includes a control valve disposed in one end of the shoot passage opposite to the frame, the control valve connected to a high-pressure air source via an air hose and electrically connected to the control unit, and the control unit includes a button and a stick mounted thereon, wherein the player leftward and rightward operates the stick to drive the drive device and adjust the position of the seat of the shoot device along the rail, and forward and backward operates the stick to drive the motor and adjust the elevation angle of the guide plate.

16. The game machine as claimed in claim 15, wherein the feeding device has an inverted J-shaped feeding tube mounted on a top thereof and wherein the ball passage aligns with the free end of the feeding tube for receiving the balls from the feeding device through the feeding tube when the seat is moved to abut the feeding device.

17. The game machine as claimed in claim 16, wherein the seat includes a funnel secured on the top thereof for guiding the ball, which is provided by the ball recover unit, moved into the ball passage.

18. The game machine as claimed in claim 5, the seat includes a control valve disposed in one end of the shoot passage opposite to the frame, the control valve connected to a high-pressure air source via an air hose and electrically connected to the control unit, and the control unit includes a button and a stick mounted thereon, wherein the player leftward and rightward operates the stick to drive the drive device and adjust the position of the seat of the shoot device along the rail, and forward and backward operates the stick to drive the motor and adjust the elevation angle of the guide plate.

19. The game machine as claimed in claim 18, wherein the feeding device has an inverted J-shaped feeding tube mounted on a top thereof and wherein the ball passage aligns with the free end of the feeding tube for receiving the balls from the feeding device through the feeding tube when the seat is moved to abut the feeding device.

20. The game machine as claimed in claim 19, wherein the seat includes a funnel secured on the top thereof for guiding the ball, which is provided by the ball recover unit, moved into the ball passage.

* * * * *